US005325998A

United States Patent [19]

Bennett

[11] Patent Number: 5,325,998

[45] Date of Patent: Jul. 5, 1994

[54] PRESSURIZED INVERTED DISPENSER

[75] Inventor: Robert A. Bennett, Easton, Conn.

[73] Assignees: Charlotte Ambrogio; Sally Conant; Robert Bennett, Stratford, Conn.

[21] Appl. No.: 106,583

[22] Filed: Aug. 16, 1993

[51] Int. Cl.[5] ..... B67D 5/00

[52] U.S. Cl. ..... 222/185; 222/509; 222/518

[58] Field of Search ..... 222/509, 518, 213, 185, 222/181, 510

[56] References Cited

U.S. PATENT DOCUMENTS

| | | | |
|---|---|---|---|
| 62,065 | 2/1867 | Phillippi | 222/518 X |
| 312,750 | 2/1885 | Newman | 222/518 X |
| 1,096,956 | 5/1914 | Sailor | 222/509 |
| 2,176,988 | 10/1939 | Cameron | 222/518 X |
| 2,486,245 | 10/1949 | Bates | 222/509 X |
| 2,637,468 | 5/1953 | Wekerle | 222/518 X |
| 3,964,631 | 6/1976 | Albert | 222/518 X |
| 4,094,433 | 6/1978 | Numbers | 222/518 X |
| 4,099,642 | 7/1978 | Nerg | 222/518 X |

*Primary Examiner*—Andres Kashnikow

*Assistant Examiner*—Anthoula Pomrening

[57] ABSTRACT

A pressurized inverted dispenser utilizes a hollow vertically elongated body having a lower end with an aperture, an upper end, a flat vertical cover and a front curved wall with a button receiving opening. The front wall, the cover, the upper end and the lower end are sealed together. The inside surface of the cover carries a connector support. A button is disposed in the opening which is slidably movable toward and away from the rear wall between depressed and extended positions. A horizontally elongated connector secured to the rear surface of the button and slidably engages the connector support. The button slidably supports a horizontal leg of a spring which also has a vertical end leg aligned with the aperture, and a U shaped central section disposed between and secured to the first and second legs. The spring normally maintains the button in extended position, with the section extending toward the aperture and the free end of the vertical leg closing and sealing the aperture, the section when the button is depressed extending away from the aperture and withdrawing the free end of the leg out of engagement with the aperture, thus opening the aperture.

6 Claims, 1 Drawing Sheet

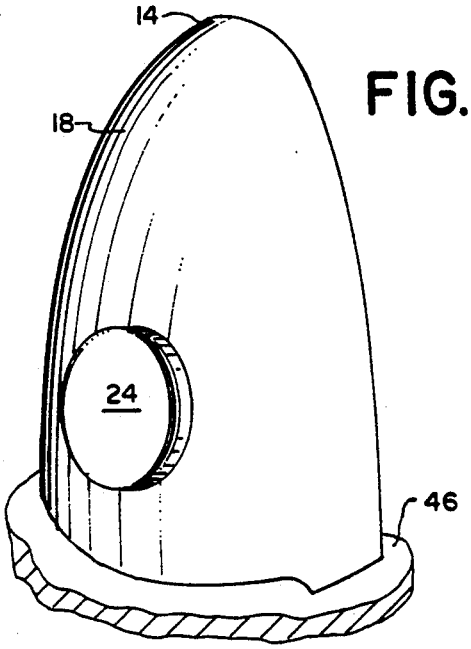
FIG. 1
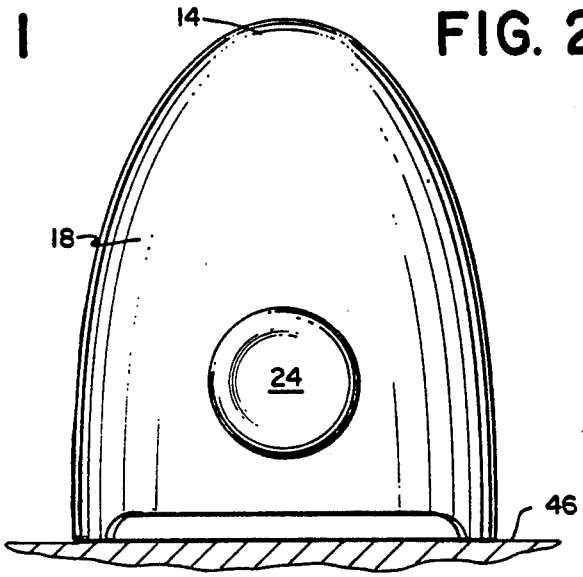
FIG. 2
FIG. 3
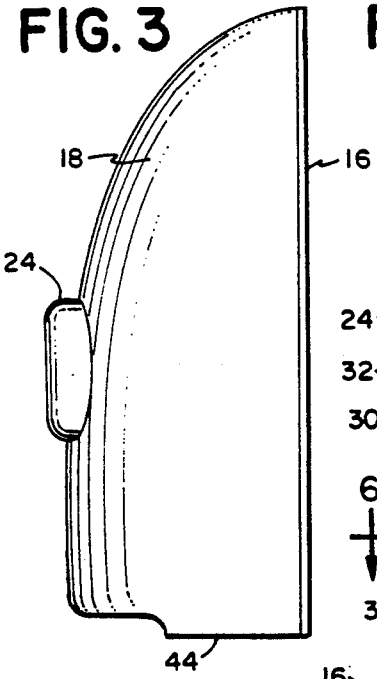
FIG. 4
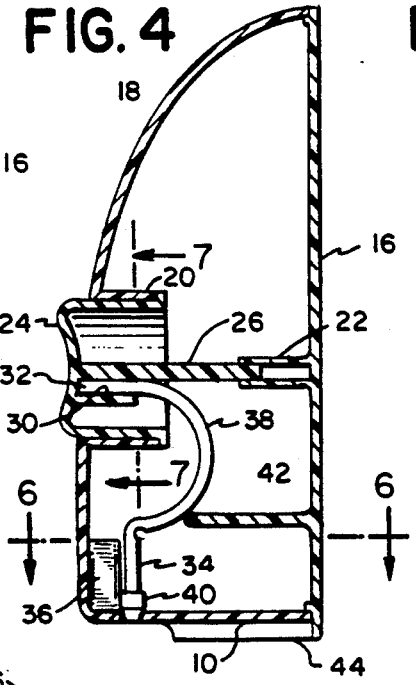
FIG. 5
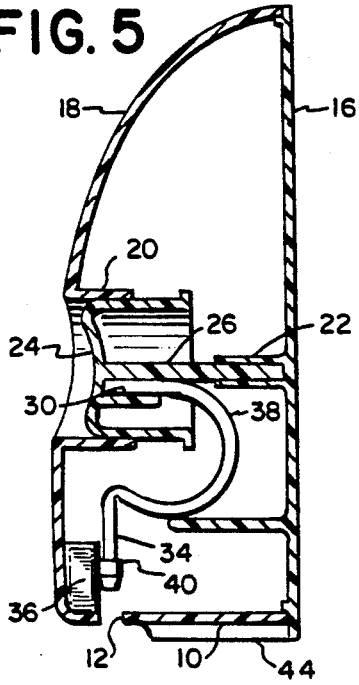
FIG. 6
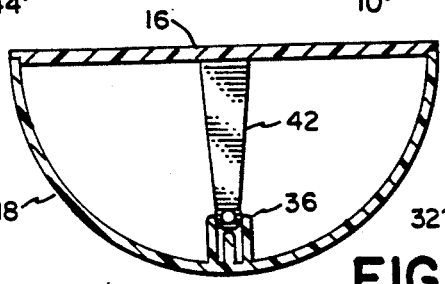
FIG. 7
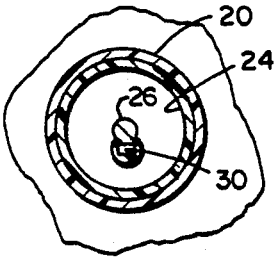
FIG. 8
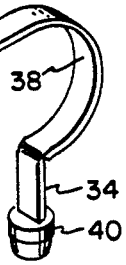

PRESSURIZED INVERTED DISPENSER

BACKGROUND OF THE INVENTION

Dispensers of viscous products such as lotions, creams and paste normally dispense the product from the top of the dispenser. While the product is discharged relatively easily, the discharge cannot be stopped or cut off cleanly and quickly, whereby the product continues to leak or dribble out of the dispenser for a short period after the discharge is discontinued, and subsequently must be cleaned or wiped off. In addition, such dispensers utilize a relatively large number of parts or components and are relatively expensive.

The present invention is directed toward a new and improved type of dispenser which overcomes these disadvantages.

SUMMARY OF THE INVENTION

It is an object of the present invention to provide a new and improved dispenser wherein once the discharge is discontinued, the flow of the fluid is immediately stopped without subsequent leakage or dribble.

Another object is to provide a new and improved dispenser of the character indicated wherein the viscous product is discharged from the bottom of the dispenser.

Still another object is to provide a new and improved dispenser of the character indicated which utilizes a minimal number of parts or components and is disposable after one use.

These and other objects and advantages of the invention will either be explained or will become apparent hereinafter.

In accordance with the principles of the invention, a pressurized inverted dispenser comprises a hollow vertically elongated body having a lower end with an aperture, an upper end, a flat vertical back cover and a front curved wall with a button receiving opening.

The front wall, the cover, the upper end and the lower end are sealed together. The inside surface of the cover being provided with first means for supporting a connector.

A button is disposed in the opening. The button has an exposed generally vertical front surface and is movable toward and away from the cover between depressed and extending positions. The button has a rear surface. A horizontally elongated connector is secured to the rear surface of the button and slidably engages the first means. The button carries second means for slidably supporting a horizontal leg of a spring.

A spring is disposed in the body. The spring has a first vertical end leg aligned with the aperture, a second horizontal end leg slidable in said second means, and a U shaped central section disposed between and secured to said first and second legs. The spring normally maintains the button in extended position, with the section extending toward the aperture and the free end of the first leg closing and sealing the aperture. The spring, when the button is depressed, extends away from the aperture and withdraws the free end of the first leg out of engagement with the aperture, thus opening the aperture.

In use, the dispenser is first assembled lacking the cover. The dispenser is then disposed horizontally with the front wall disposed downward and the viscous product to be dispensed is poured into the body. The cover is then connected and sealed to the body. The aperture is engaged by the free end of the first leg, which closes and seals the aperture. The dispenser can then be held and used with the lower end disposed at the bottom of the dispenser. If desired, the cover of the dispenser can be secured to a suitable vertical support such as a bathroom wall.

In order to dispense product, the button is momentarily depressed by manual pressure. This action moves the spring device and withdraws the free end of the first leg from engagement with the aperture, and the viscous product flows downward by gravity action out of the aperture. When the pressure on the button is released, the spring device moves the free end of the first leg into sealing engagement with the aperture.

Since the flow of the product, due both to its viscosity and the gravity action, is relatively slow and the action of the spring device is very fast, once the aperture is sealed, discharge therethrough stops immediately without leakage or dribble.

The dispenser is disposable after use.

BRIEF DESCRIPTION OF THE DRAWINGS

FIG. 1 is a front perspective view of a dispenser in accordance with the invention ready for use.

FIG. 2 is a front view of the dispenser of FIG. 1.

FIG. 3 is a side view of the dispenser of FIG. 1.

FIG. 4 is a vertical cross section of the dispenser of FIG. 1 with the button shown in extended position.

FIG. 5 is a view similar to that of FIG. 4 except that the button is shown in depressed position.

FIG. 6 is a view taken along line 6—6 in FIG. 4.

FIG. 7 is a view taken along line 7—7 in FIG. 4.

FIG. 8 is a perspective view of the spring.

DETAILED DESCRIPTION OF PREFERRED EMBODIMENT

Referring now to FIGS. 1–8, a pressurized inverted dispenser comprises a hollow vertically elongated body having a lower end 10 with an aperture 12, an upper end 14, a flat vertical back cover 16 and a front curved wall 18 with a button receiving opening. The opening is formed by an integral horizontal cylinder 20.

The front wall, the cover, the upper end and the lower end are sealed together. The inner surface of the cover supports a clip 22.

A button 24 is slidably disposed in the cylinder. The button has an exposed generally vertical front surface and is movable toward and away from the cover between depressed and extending positions. The button has a rear surface. A horizontally elongated member or connector 26 is secured to the rear surface of the button and slidably engages the clip 22. The button carries a horizontal member 30 closely spaced from connector 26.

The space between member 30 and connector 26 slidably receives and supports a horizontal leg 32 of a spring disposed in the body. The spring has a first vertical end leg 34 aligned with the aperture, the second horizontal end 32, and a U shaped central section 38 disposed between and secured to said first and second legs. The spring normally maintains the button in extended position, with the section extending toward the aperture and the free end of the first leg closing and sealing the aperture. The spring, when the button is depressed, extends away from the aperture and withdraws the free end of the first leg out of engagement with the aperture, thus opening the aperture. The free end of the first leg has a tapered head 40 for providing the sealing engagement with the aperture.

A horizontal member 42 is disposed adjacent the section 38 and the rear wall and extends parallel to the connector from the rear wall. The member 42 engages the section 38, pushing a portion of the section toward the button when the aperture is closed and pushing the section 38 upward when the aperture is opened.

A vertical guide 36 for confining and guiding the head 40 is secured both to the front wall and to the lower end adjacent the aperture.

The dispenser can then be held and used with the lower end disposed at the bottom of the dispenser. The lower end has a downwardly projecting peripheral support 44 which enables the dispenser to be self supporting on a horizontal surface 46.

While the invention has been described with particular reference to the detailed description and the drawings, the protection sought is to be limited only by the terms of the claims which follow.

What is claimed is:

1. A pressurized inverted dispenser comprising:

a hollow vertically elongated body having a lower end with an aperture, an upper end, a flat vertical cover and a front curved wall with a button receiving opening, the front wall, the cover, the upper end and the lower end being sealed together, the inside surface of the cover being provided with first means for supporting a connector;

a button disposed in the opening having an exposed generally vertical front surface and slidably movable toward and away from the cover between depressed and extended positions, the button having a rear surface, a horizontally elongated connector secured to the rear surface and slidably engaging the first means, and second means for slidably supporting a horizontal leg of a spring; and a spring disposed in the body, the spring having a first vertical end leg aligned with the aperture and a second horizontal end leg, said horizontal end leg slidable in said second means, and a U shaped central section disposed between and secured to said first and second legs, the spring normally maintaining the button in the extended position, with the section extending toward the aperture and the free end of the first leg closing and sealing the aperture, the section when the button is depressed extending away from the aperture and withdrawing the free end of the first leg out of engagement with the aperture, thus opening the aperture.

2. The dispenser of claim 1 wherein the opening is defined by a hollow horizontal cylinder open at both ends and extending inwardly from and integral with the front wall.

3. The dispenser of claim 2 wherein the free end of the first leg has a tapered head for sealing engagement with the aperture.

4. The dispenser of claim 3 further including vertical guide means for the head which is disposed within the body and secured both to the front wall and the lower end adjacent the aperture.

5. The dispenser of claim 4 wherein the first means is a horizontal clip.

6. The dispenser of claim 5 wherein the second means includes a horizontal member closely spaced from the connector, the second leg being disposed in the space between the horizontal member and the connector.

* * * * *